US007878495B2

(12) United States Patent
Nishimura et al.

(10) Patent No.: US 7,878,495 B2
(45) Date of Patent: Feb. 1, 2011

(54) IMAGE FORMING APPARATUS

(75) Inventors: Shunsuke Nishimura, Toride (JP); Manabu Yamauchi, Kashiwa (JP); Naoto Watanabe, Abiko (JP); Takayuki Fujii, Tokyo (JP); Mitsuhiko Sato, Kashiwa (JP); Hidenori Sunada, Toride (JP); Ichiro Sasaki, Toride (JP); Akinobu Nishikata, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 408 days.

(21) Appl. No.: 11/469,695

(22) Filed: Sep. 1, 2006

(65) Prior Publication Data

US 2007/0057446 A1 Mar. 15, 2007

(30) Foreign Application Priority Data

Sep. 12, 2005 (JP) ..... 2005-264432
Aug. 11, 2006 (JP) ..... 2006-220644

(51) Int. Cl.
*B65H 7/02* (2006.01)

(52) U.S. Cl. ..... 270/58.02; 270/58.07; 271/176; 271/258.03

(58) Field of Classification Search ..... 270/58.01, 270/58.02, 58.07; 271/176, 258.03
See application file for complete search history.

(56) References Cited

U.S. PATENT DOCUMENTS 5,492,315 A 2/1996 Maruyama et al. ..... 270/95
5,629,775 A 5/1997 Platteter et al.
5,722,650 A 3/1998 Yamamoto et al.
5,735,515 A 4/1998 Hayashi et al.
5,752,154 A 5/1998 Maruyama et al. ..... 399/407
5,769,406 A 6/1998 Sato
5,778,300 A 7/1998 Murakami et al.
6,633,990 B1 10/2003 Eisenberg
6,669,384 B2 * 12/2003 Furuya et al. ..... 400/624
6,672,586 B2 * 1/2004 Murata et al. ..... 271/256
7,175,173 B2 * 2/2007 Anzai et al. ..... 270/58.09
7,413,178 B2 * 8/2008 Fujii et al. ..... 270/58.11
2002/0181002 A1 12/2002 Leyva
2005/0042007 A1 2/2005 Fujii et al.
2005/0067748 A1 * 3/2005 Fujii et al. ..... 270/58.08
2005/0121847 A1 * 6/2005 Anzai et al. ..... 270/58.08

(Continued)

FOREIGN PATENT DOCUMENTS

EP 1 037 125 9/2000

(Continued)

*Primary Examiner*—Leslie A Nicholson, III
(74) *Attorney, Agent, or Firm*—Fitzpatrick, Cella, Harper & Scinto

(57) ABSTRACT

Timing information for use to determine the timing to discharge a sheet from an image forming apparatus is transmitted. The timing information is relayed, by being edited repeatedly, from a first sheet processing apparatus connected directly with the image forming apparatus to a second sheet processing apparatus which actually processes the sheet. The timing information is edited on each sheet processing apparatus by considering, for example, transit time of the sheet, processing time of the sheet, preparation time for the sheet to get ready to be processed, and the like. The second sheet processing apparatus transmits the timing information to the image forming apparatus. The image forming apparatus determines the discharge timing of the sheet based on the received timing information and discharges the sheet with the determined discharge timing.

7 Claims, 13 Drawing Sheets

U.S. PATENT DOCUMENTS

| | | | | |
|---|---|---|---|---|
| 2007/0170635 | A1 * | 7/2007 | Saitsu et al. | 270/58.08 |

FOREIGN PATENT DOCUMENTS

| | | |
|---|---|---|
| JP | 62-191358 | 8/1987 |
| JP | 6-286931 | 10/1994 |
| JP | 10-194528 | 7/1998 |
| JP | 11-208979 | 8/1999 |
| JP | 2001-341366 | 12/2001 |
| JP | 2005-31382 | 2/2005 |
| JP | 2005-070078 | 3/2005 |
| JP | 2005-170628 | 6/2005 |

* cited by examiner

FIG. 10

| TIMING INFORMATION | | VALUE |
|---|---|---|
| TIMING INFORMATION 601 | SHEET ID | 1 |
| | TRAVEL TIME ($T_{arv, i \rightarrow s}$) | 1000 |
| | PREVIOUS SHEET ID | 0 |
| | SHEET-TO-SHEET TIME INTERVAL ($T_{ss, i \rightarrow s}$) | 0 |
| | SHEET-LOADING-APPARATUS INFORMATION TID | FINISHER 103 |
| TIMING INFORMATION 602 | SHEET ID | 1 |
| | TRAVEL TIME ($T_{arv, s \rightarrow f}$) | 1000+800=1800 |
| | EXTENSION TIME ($T_{ext, s}$) | 0 |
| | PREVIOUS SHEET ID | 0 |
| | SHEET-TO-SHEET TIME INTERVAL ($T_{ss, s \rightarrow f}$) | 0 |
| | DELAY TIME ($T_{dly, s}$) | 300−0=300 |
| | SHEET-LOADING-APPARATUS INFORMATION TID | FINISHER 103 |
| TIMING INFORMATION 603 | EXTENSION TIME ($T_{ext, f}$) | 2000−1800+0=200 |
| | DELAY TIME ($T_{dly, f}$) | 4100−0+300=4400 |

FIG. 11

| TIMING INFORMATION | | VALUE |
|---|---|---|
| TIMING INFORMATION 601 | SHEET ID | 2 |
| | TRAVEL TIME ($T_{arv, i \rightarrow s}$) | 1000 |
| | PREVIOUS SHEET ID | 1 |
| | SHEET-TO-SHEET TIME INTERVAL ($T_{ss, i \rightarrow s}$) | 500 |
| | SHEET-LOADING-APPARATUS INFORMATION TID | STACKER 102 |
| TIMING INFORMATION 701 | EXTENSION TIME ($T_{ext, s}$) | 0 |
| | DELAY TIME ($T_{dly, s}$) | 0 |

FIG. 12

| TIMING INFORMATION | | VALUE |
|---|---|---|
| TIMING INFORMATION 601 | SHEET ID | 3 |
| | TRAVEL TIME ($T_{arv, i \rightarrow s}$) | 1000 |
| | PREVIOUS SHEET ID | 2 |
| | SHEET-TO-SHEET TIME INTERVAL ($T_{ss, i \rightarrow s}$) | 500 |
| | SHEET-LOADING-APPARATUS INFORMATION TID | FINISHER 103 |
| TIMING INFORMATION 602 | SHEET ID | 3 |
| | TRAVEL TIME ($T_{arv, s \rightarrow f}$) | 1000+800=1800 |
| | EXTENSION TIME ($T_{ext, s}$) | 0 |
| | PREVIOUS SHEET ID | 1 |
| | SHEET-TO-SHEET TIME INTERVAL ($T_{ss, s \rightarrow f}$) | 500+500=1000 |
| | DELAY TIME ($T_{dly, s}$) | 0 |
| | SHEET-LOADING-APPARATUS INFORMATION TID | FINISHER 103 |
| TIMING INFORMATION 603 | EXTENSION TIME ($T_{ext, f}$) | 2000−1800+0=200 |
| | DELAY TIME ($T_{dly, f}$) | 4100−1000+0=3100 |

IMAGE FORMING APPARATUS

This application claims the benefit of Japanese Patent Application Nos. 2005-264432, filed Sep. 12, 2005, and 2006-220644, filed Aug. 11, 2006, which are hereby incorporated by reference herein in their entirety.

BACKGROUND OF THE INVENTION

1. Field of the Invention

The present invention relates to an image forming apparatus which uses a plurality of sheet processing apparatuses equipped with sheet processing functions and arranged and connected serially.

2. Description of the Related Art

Conventionally, an image forming apparatus connected with sheet processing apparatuses such as a finisher and sorter (sometimes called post-processing units) have been used for personal purposes and business purposes. Today, however, along with improvements in the image quality and increase in the speed of image forming apparatus, they are coming into use in the print industry as well.

In the print industry, various types of sheet processing (post-processing) are required for bookbinding. Typical sheet processing includes a stapling process, folding process, and punch process. Sometimes, multiple types of sheet processing are used in combination. In that case, it is preferable to serially arrange multiple sheet processing apparatuses with different sheet processing functions and connect them to an image forming apparatus (Japanese Patent Laid-Open No. 6-286931).

When using multiple sheet processing apparatuses, it is necessary to take into consideration processing time on each sheet processing apparatus and preparation time (start-up time) required for the sheet processing apparatus to get ready for processing. For example, if the image forming apparatus or an upstream sheet processing apparatus discharges a sheet to a sheet processing apparatus connected downstream even though the downstream sheet processing apparatus is not ready, troubles such as paper jam will occur.

To solve this, it is conceivable to discharge the sheet based on the last sheet processing apparatus that gets ready. However, this method can delay the timing of discharge and slow down the printing process if the last sheet processing apparatus is not in use. This results in low processing efficiency. That is, sheet processing apparatuses that finally stacks a sheet sometimes vary on a sheet-by-sheet basis, and thus appropriate timing of discharge can vary from sheet to sheet.

Thus, from all the sheet processing apparatuses serially arranged and connected, it is desirable to consider the preparation and processing time required to go from the sheet processing apparatus connected directly with the image forming apparatus, to the sheet processing apparatus which actually performs sheet processing.

SUMMARY OF THE INVENTION

The present invention is implemented, for example, as an image forming system which uses multiple sheet processing apparatuses equipped with sheet processing functions and arranged and connected serially. Timing information to determine the timing of sheet discharge from an image forming apparatus is relayed from a first sheet processing apparatus to a second sheet processing apparatus by being edited repeatedly. The first sheet processing apparatus is the sheet processing apparatus directly connected to the image forming apparatus. The second sheet processing apparatus is the sheet processing apparatus which actually processes the sheet (e.g., stacks the sheet on itself).

The timing information is edited on each sheet processing apparatus, taking into consideration transit time of the sheet, processing time of the sheet, preparation time for the sheet to get ready to be processed and the like. This is needed to determine practically the shortest time needed to accept the sheet without a jam. Incidentally, the editing of timing information includes not only direct editing of the original timing information, but also generation of new timing information based on the original timing information. The second sheet processing apparatus transmits the timing information destined to the image forming apparatus. The image forming apparatus determines timing to discharge the sheet based on the received timing information and discharges the sheet at the determined discharge timing.

Thus, according to the present invention, timing information is transferred from the image forming apparatus to the sheet processing apparatus. The timing information is edited successively by taking into consideration the preparation time and the like on each sheet processing apparatus. That is, by considering the sheet processing apparatus up to the one which actually processes the sheet instead of considering all the sheet processing apparatus connected to the image forming apparatus, it is possible to achieve a higher processing efficiency than the former case.

Further features of the present invention will become apparent from the following description of exemplary embodiments with reference to the attached drawings.

BRIEF DESCRIPTION OF THE DRAWINGS

FIG. 10 is a diagram showing an example of timing information about a first sheet;

FIG. 11 is a diagram showing an example of timing information about a second sheet;

FIG. 12 is a diagram showing an example of timing information about a third sheet.

DESCRIPTION OF THE EMBODIMENTS

An embodiment of the present invention will be described below. The embodiment described below will be useful in understanding various concepts of the present invention including superordinate concepts, subordinate concepts, and lower subordinate concepts. However, it should be noted that the scope of the present invention is decided only by the appended claims, and is not limited to the embodiment described below.

Figure 1:
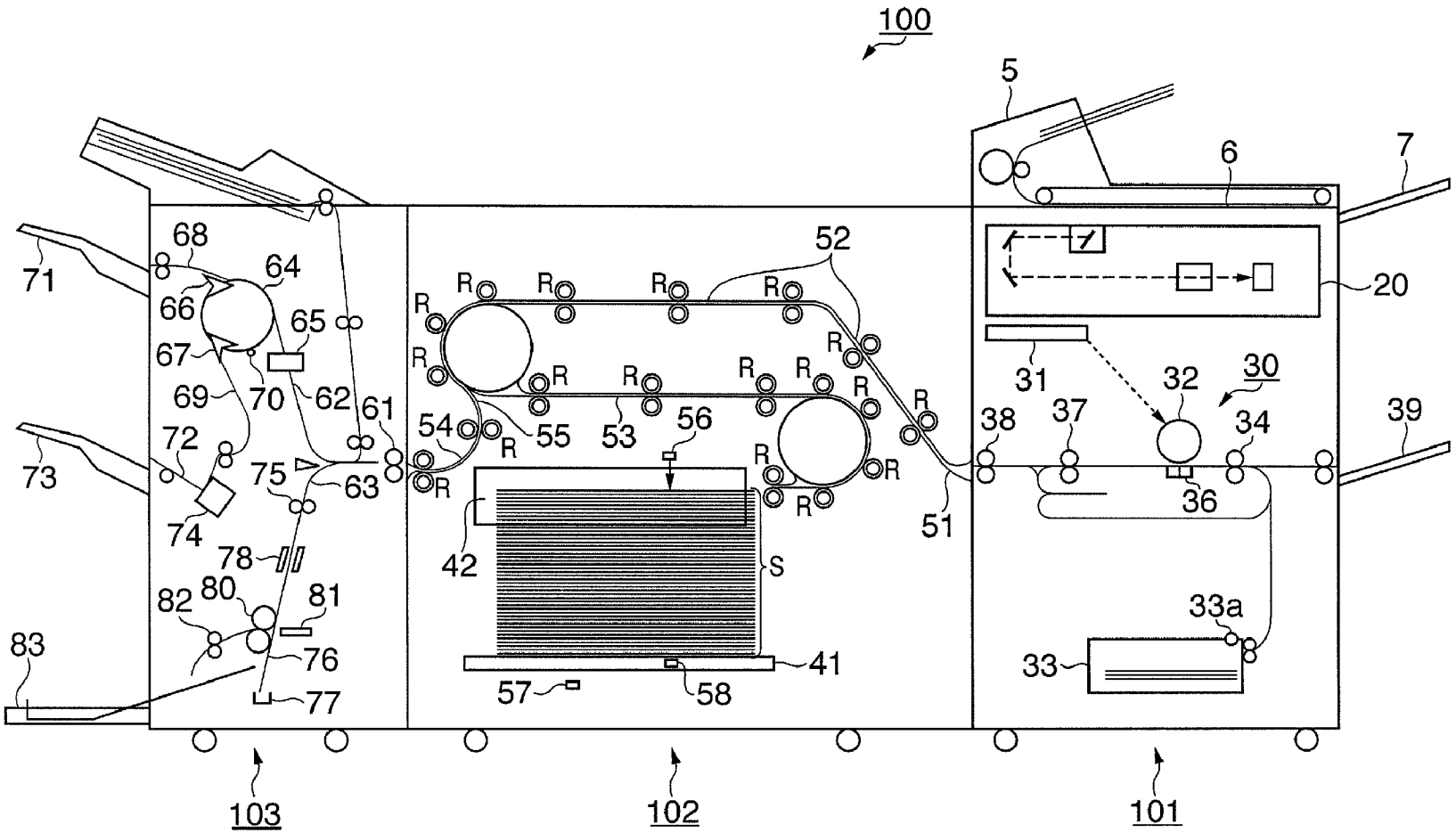
FIG. 1 is an exemplary sectional view showing main components of an image forming system according to the embodiment.

FIG. 1 is an exemplary sectional view showing main components of an image forming system according to an embodiment. The image forming system 100 mainly includes an image forming apparatus 101 and a plurality of sheet processing apparatuses arranged and connected serially (e.g., a stacker 102, finisher 103, etc.). The stacker 102 and finisher 103 are sheet processing apparatus which have a sheet-stacking function. The stacker 102 mainly has only a sheet-stacking function. On the other hand, the finisher 103 has at least one of advanced sheet processing functions such as a folding function, punch function, and stapling function in addition to the sheet-stacking function.

For convenience of explanation, an example in which two sheet processing apparatuses are connected to the image forming apparatus 101 will be described below, although the present invention is not limited to this. That is, the present invention is also applied suitably to an image forming system to which more than two processing apparatuses are connected serially. Specifically, one or more other sheet processing apparatuses (e.g., an inserter, a puncher, another stacker, etc.) may be connected between the image forming apparatus 101 and stacker 102. Similarly, one or more other sheet processing apparatuses (e.g., an inserter, a puncher, another stacker, a starching/bookbinding machine etc.) may be connected between the stacker 102 and finisher 103.

(About Image Forming Apparatus)

The image forming apparatus 101 is equipped with an image reader 20 which reads original images as well as with an image forming unit 30. The image reader 20 is equipped with an automatic document feeder 5. The automatic document feeder 5 feeds an original document sheet by sheet from a document tray. The image reader 20 reads an original document while the original document is conveyed from left to right on platen glass 6. After that, the original document is discharged to a paper output tray 7.

An exposure control unit 31 of the image forming unit 30 modulates a laser beam based on a video signal from the image reader 20. The laser beam is directed at a photoconductive drum 32 through scanning by a polygon mirror. An electrostatic latent image is formed on the photoconductive drum 32 according to the scanning laser beam. The electrostatic latent image on the photoconductive drum 32 is visualized as a developer image by a developer supplied from a developing device (not shown).

The image forming unit 30 has one or more paper cassettes 33 containing sheets (recording medium such as paper). Each sheet is supplied from the paper cassette 33 to the image forming unit 30 by a sheet feeder-separator 33*a* such as a pickup roller. A hard sheet such as an OHP sheet may also be supplied through a manual sheet feeder 39.

The registration roller 34 temporarily stops a sheet and re-conveys the sheet to a nip portion formed between the photoconductive drum 32 and a transfer unit 36 at an appropriate timing. This timing is determined based on timing information described later. A developer image formed on the photoconductive drum 32 is transferred to the sheet by the transfer unit 36. Timing of image formation on the photoconductive drum 32 is also determined based on the timing information described later.

The sheet to which the developer image has been transferred is conveyed to a fixing unit 37. The fixing unit 37 fixes the developer image on the sheet by heating the sheet under pressure. After passing through the fixing unit 37 and a discharge roller 38, the sheet is discharged directly to a first sheet processing apparatus directly connected to the image forming apparatus. In the example in FIG. 1, the first sheet processing apparatus is the stacker 102.

(About Stacker)

The stacker 102 takes in the sheets from the image forming apparatus 101 one after another and stacks them onto a stack tray 41 or transfers them to the finisher 103. The transfer process is sometimes called a sheet transit process.

The stack tray 41 is generally stacked with a large number of sheets discharged from the image forming apparatus 101. A sheet retaining member 42 is intended to make it easier to stack sheets on the stack tray 41.

A sheet entrance 51 is used to receive the sheets discharged from the image forming apparatus 101. A conveyance path 52 is used to convey sheets in the stacker 102. The conveyance path 52 branches into a conveyance path 53 for sheet stacks and a conveyance path 54 to discharge sheets downstream.

The conveyance path 53 is used to stack sheets on the stack tray 41. The conveyance path 54 is used to discharge sheets to the finisher 103. Switchover between the conveyance path 53 and conveyance path 54 are accomplished by a flapper 55. A plurality of conveyance rollers Rs are used in any of the conveyance paths 52, 53 and 54 to convey sheets.

A detection sensor 56 detects the top sheet, or the sheet on the top face of the stack tray 41. The detection sensor 56 is used to keep the stack tray 41 at a sheet-receiving position when sheets are stacked on the stack tray 41 one after another. A detection sensor 57 detects a lower limit of the stack tray 41. When lowering the stack tray 41 to a sheet retrieval position, it is lowered until the detection sensor 57 detects the stack tray 41.

(Finisher)

The finisher 103 takes in the sheets from the stacker 102 one after another and performs various types of sheet processing on them, including the process of aligning a plurality of sheets and bundling them as a batch of sheets as well as a stapling process for binding the rear end of the batch of sheets with staples. The finisher 103 also performs a punch process for punching holes near the rear end of sheets, sorting process for sorting a plurality of sheets, bookbinding process for starching and binding the plurality of sheets.

The finisher 103 has an entrance roller pair 61 which introduces the sheets discharged from the stacker 102. Downstream of the entrance roller pair 61, a conveyance path from the entrance roller pair 61 branches into a process tray path 62 and bookbinding path 63. A flapper is installed at the branch point to select a path for use to convey sheets.

The sheets led to the process tray path 62 are conveyed to a buffer roller 64 via a conveyance roller pair (not shown). A punch unit 65 is installed on the process tray path 62. It punches near the rear end of arriving sheets as required.

The buffer roller 64 can wind a predetermined number of stacked sheets around itself. A plurality of press-down rollers (not shown) are placed around the buffer roller 64 to wind the sheets around it as required. The sheets wound around the buffer roller 64 is conveyed in the rotation direction of the buffer roller 64.

Switching flappers 66 and 67 are installed near a conveyance path around the buffer roller 64. The upstream flapper 66 separates the sheets wound around the buffer roller 64 from the buffer roller 64 and leads them to a non-sort path 68 or a sort path 69. The downstream flapper 67 either separates the sheets wound around the buffer roller 64 from the buffer roller 64 and leads them to the sort path 69 or leads the sheets wound around the buffer roller 64 to a buffer path 70 as they are.

The sheets led to the non-sort path 68 are discharged to a sample tray 71 via a discharge roller pair (not shown). The sheets led to the sort path 69 are stacked on a processing tray 72 via a conveyance roller (not shown). The sheets stacked in a bundle on the processing tray 72 are subjected to an alignment process or stapling process as required. Subsequently, the sheets are discharged onto a stack tray 73 via a discharge roller (not shown). A stapler 74 is used in the stapling process for stapling the sheets stacked in a bundle on the processing tray 72. The stack tray 73 is designed to be movable vertically and moves according to the quantity of sheets to be bundled.

The sheets led to the bookbinding path 63 are stored in a storage guide 76 by a conveyance roller pair 75. The sheets are conveyed further until their tip touches a sheet positioning member 77 which is movable vertically. A pair of left and right staplers 78 are installed midway along the storage guide 76. The staplers 78 are designed to staple a batch of sheets in the center.

A folding roller pair 80 is installed downstream of the staplers 78. A protruding member 81 is installed opposite the folding roller pair 80. As the protruding member 81 protrudes toward a batch of sheets stored in the storage guide 76, the batch of sheets is extruded between the folding roller pair 80 and folded by the folding roller pair 80. After that, the folded sheets are discharged to a saddle discharge tray 83 via a sheet discharge roller 82.

It is also possible to fold the batch of sheets stapled by the staplers 78. For that, the sheet positioning member 77 descends a distance needed to place the stapled position of the batch of sheets at the center of the folding roller pair 80.

(Control Units of Various Apparatus)

Figure 2:
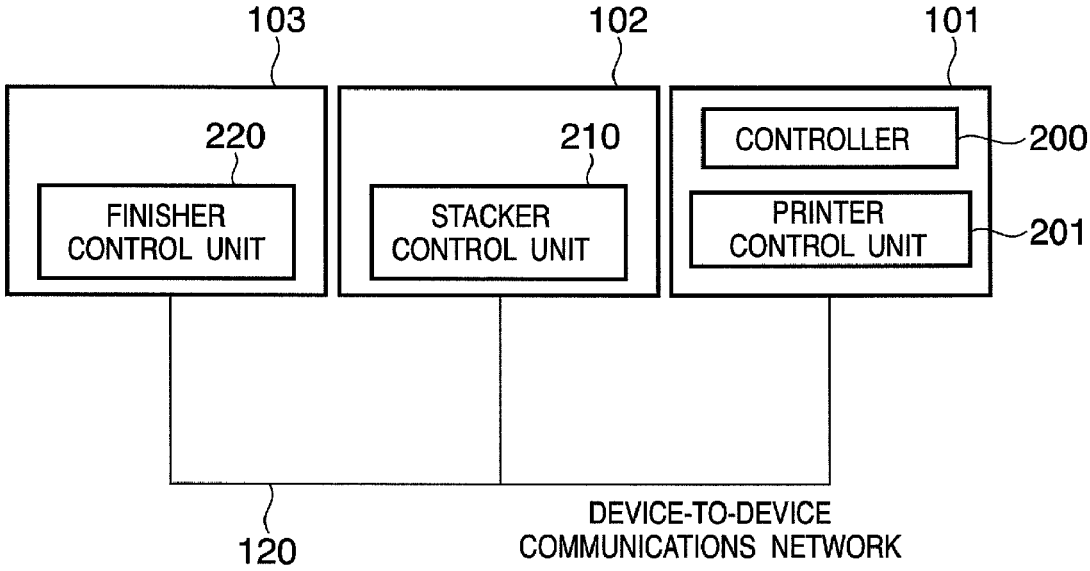
FIG. 2 is a diagram illustrating operation of the image forming system according to the embodiment.

FIG. 2 is a diagram illustrating operation of the image forming system according to the embodiment. In the figure, control units of the image forming apparatus 101, stacker 102, and finisher 103 are mutually connected via a device-to-device communications network 120. The apparatus exchange sheet information and discharge timing needed for sheet processing via the device-to-device communications network 120.

The image forming apparatus 101 is equipped with a controller 200 which manages jobs as well as with a printer control unit 201 which controls image formation and sheet conveyance. The stacker 102 is equipped with a stacker control unit 210 which controls sheet conveyance and sheet processing. The finisher 103 is equipped with a finisher control unit 220 which controls sheet conveyance and sheet processing.

Figure 3:
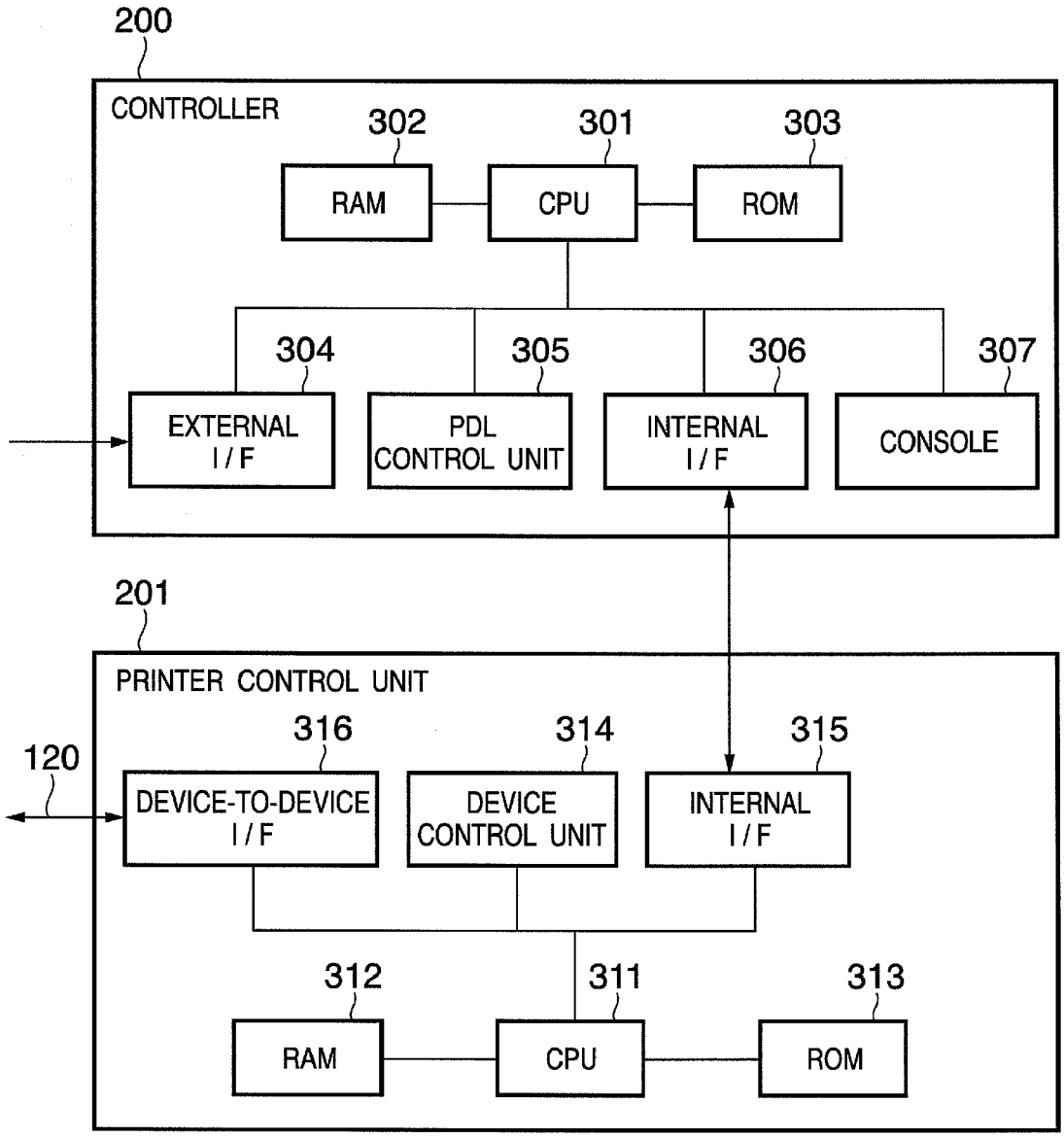
FIG. 3 is an exemplary block diagram showing control units of an image forming apparatus 101 according to the embodiment.

FIG. 3 is an exemplary block diagram showing control units of the image forming apparatus 101 according to the embodiment. In the controller 200, a CPU 301 is connected with a ROM 303 containing a control program and RAM 302 used to store data to be processed, via an address bus and data bus. The CPU 301 is also connected with an external interface 304, PDL control unit 305, and internal interface 306. The external interface 304 is a communications circuit used to communicate with an external PC or reader 20. The PDL control unit 305 is a processing circuit which processes and accumulates received print data and performs image processing. The internal interface 306 is a communications circuit used to communicate with the printer control unit 201.

Furthermore, the CPU 301 is connected with a console 307. The CPU 301 controls a display device (e.g., liquid crystal display device) on the console 307 and key input device (e.g., touch panel). The CPU 301 accepts a display switch command from an operator via the key input device. The CPU 301 displays information on the display device on the console 307, including operating status of devices and operation mode set by key input.

A CPU 311 of the printer control unit 201 performs basic control of image forming operation. The CPU 311 is connected with a RON 313 and RAM 312 via an address bus and data bus. The ROM 313 contains a control program including control procedures and the like described later. The RAM 312 contains data needed for an image forming process.

A device control unit 314 is an electric circuit including input/output ports used to control various components of a printer. An internal interface 315 is a communications circuit used to exchange image signals and timing signals with the controller 200. A device-to-device interface 316 is a communications circuit used to exchange sheet information and timing information with various sheet processing apparatus.

Based on the control program, the CPU 311 receives an image signal from the controller 200 and controls the device control unit 314, thereby performing an image forming operation. Furthermore, the CPU 311 controls a sheet conveyance operation by exchanging sheet information and timing information with other apparatuses via the device-to-device interface 316.

Figure 4:
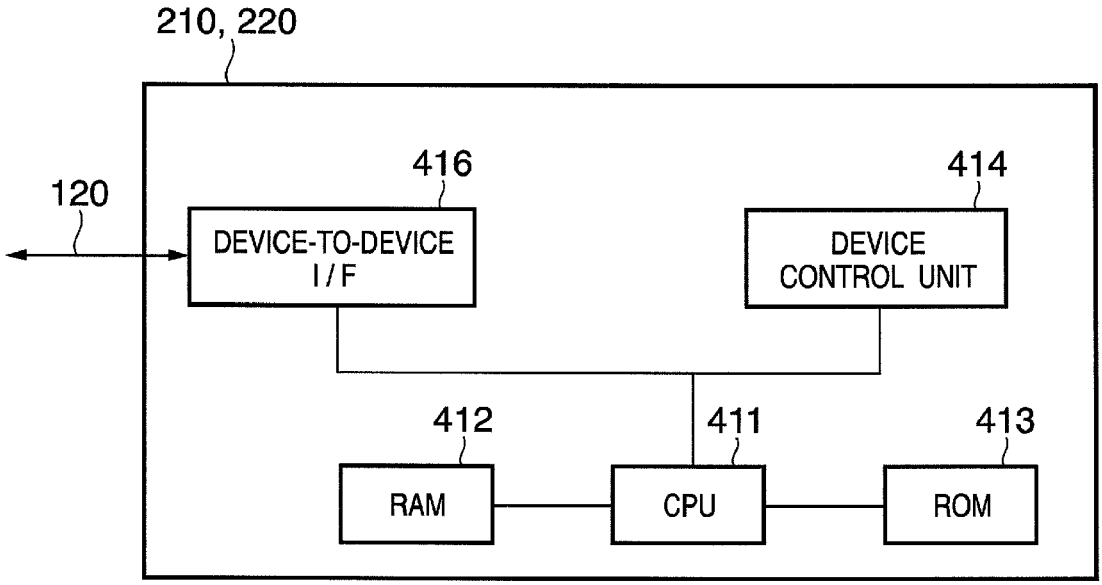
FIG. 4 is an exemplary block diagram showing a control unit of a sheet processing apparatus according to the embodiment.

FIG. 4 is an exemplary block diagram showing a control unit of the sheet processing apparatus according to the embodiment. For convenience of explanation, it is assumed that the stacker control unit 210 and finisher control unit 220 have similar configurations. However, of course, they may have different configurations.

A CPU 411 controls sheet conveyance and sheet processing. The CPU 411 is connected with a ROM 413 and RAM 412 via an address bus and data bus. The ROM 413 contains a control program including control procedures and the like described later. The RAM 412 contains data needed for sheet processing and sheet conveyance processes. A device control unit 414 is an electric circuit including input/output ports used to control various components of the sheet processing apparatus. A device-to-device interface 416 is a communications circuit used to exchange sheet information and timing information with other sheet processing apparatuses or the image forming apparatus.

Based on the control program, the CPU 411 controls sheet processing and sheet conveyance processes by exchanging sheet information and timing information with other apparatuses via the device-to-device interface 416.

(Sheet Discharge Timing Control)

According to the present invention, timing information is transferred from the image forming apparatus 101 to the sheet processing apparatus which actually processes the sheet. The timing information is edited successively on the sheet processing apparatus by taking into consideration the preparation time and the like on each sheet processing apparatus. That is, by considering all of the sheet processing apparatus connected between the image forming apparatus 101 and the sheet processing apparatus which actually processes the sheet, it is possible to improve processing efficiency.

Figure 5:
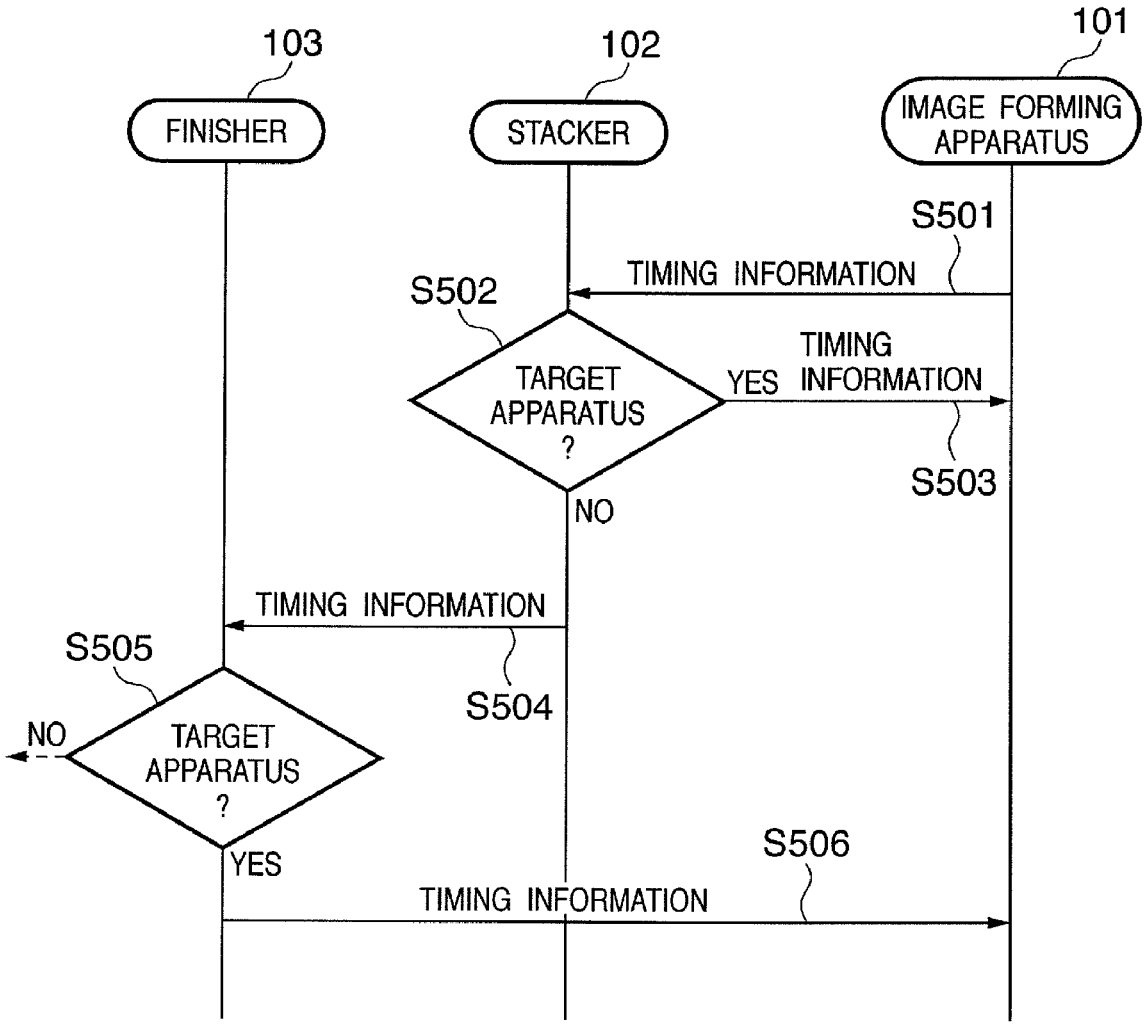
FIG. 5 is an exemplary sequence diagram showing a transfer process of timing information according to the embodiment.

FIG. 5 is an exemplary sequence diagram showing a transfer process of timing information according to the embodiment. In Step S501, the image forming apparatus 101 sends the stacker 102 timing information for use to determine timing to discharge a sheet. The timing information includes identification information about a sheet processing apparatus which will be stacked with the sheet.

In Step S502, upon receiving the timing information, the stacker 102 determines, based on the identification information contained in the timing information, whether it is specified as a target apparatus for sheet-stacking. If the stacker 102 is the target apparatus, the flow goes to Step S503. In Step S503, the stacker 102 edits the timing information, taking into consideration its preparation period and sheet processing time and transmits the edited timing information to the image forming apparatus 101. If the stacker 102 is not the target apparatus, the flow goes to Step S504, where the stacker 102 edits the timing information, taking into consideration the transit time required to transit the sheet, and transmits the edited timing information to the finisher 103 located downstream.

In Step S505, upon receiving the timing information, the finisher 103 determines, based on the identification information contained in the timing information, whether it is specified as the target apparatus. If the finisher 103 is a target apparatus for sheet-stacking apparatus, the flow goes to Step S506. In Step S506, the finisher 103 edits the timing information, taking into consideration its preparation period and sheet processing time and transmits the edited timing information to the image forming apparatus 101. On the other hand, if the finisher 103 is not the target apparatus, the finisher 103 edits the timing information, taking into consideration the transit time required to transit the sheet, and transmits the edited timing information to the sheet processing apparatus located downstream. In the example of FIG. 1, since no more sheet processing apparatus exists downstream, Step S505 may be omitted. Based on the received timing information, the image forming apparatus 101 controls the timing of sheet discharge. Specifically, the timing of image formation on the photoconductive drum and re-conveyance timing of the sheet suspended by the registration roller 34 are controlled so that the stacker 102 or finisher 103 can receive the sheet with the timing it requests.

Figure 6:
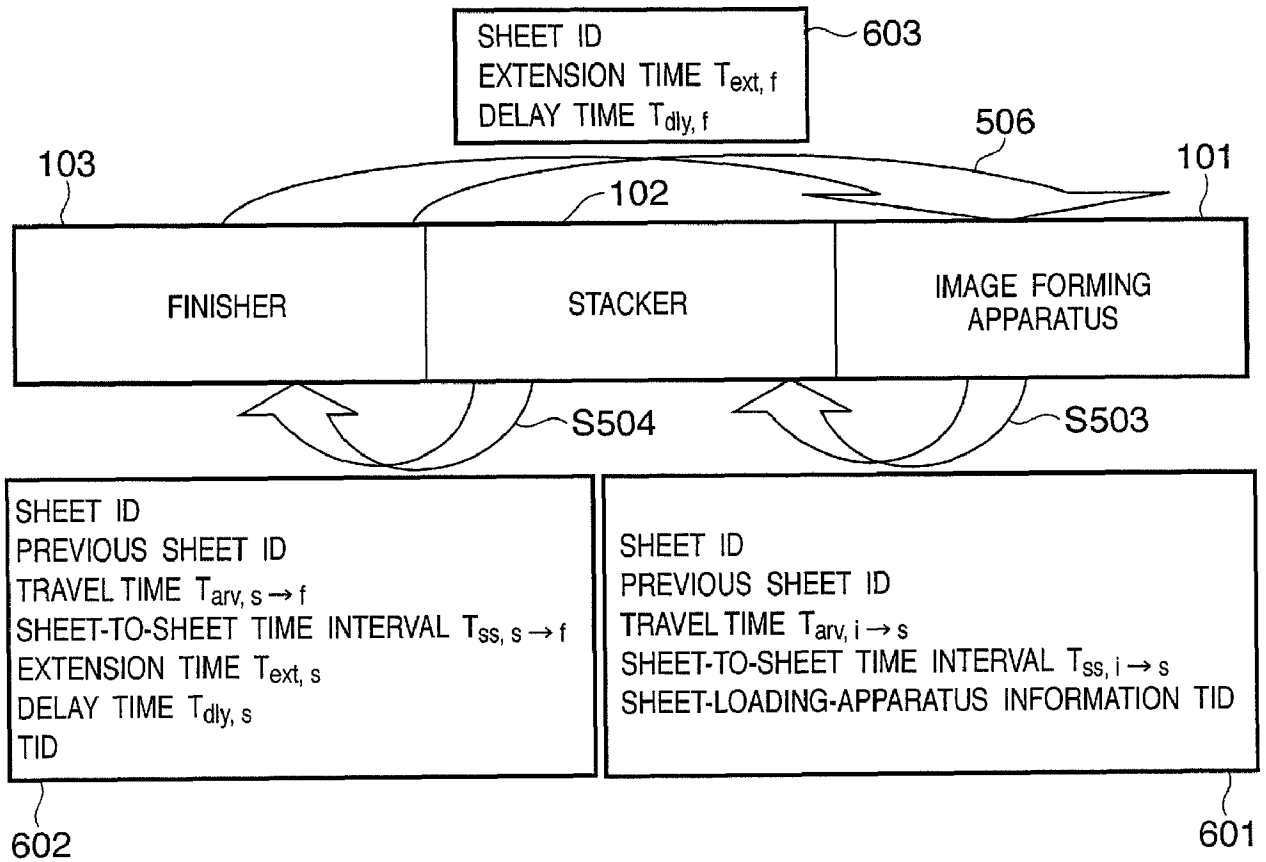
FIG. 6 is a diagram showing an example of various timing information needed when a finisher operates as a sheet processing apparatus which is stacked with sheets.

FIG. 6 is a diagram showing an example of various timing information needed when a finisher operates as a sheet processing apparatus which is stacked with a sheet. Specifically, FIG. 6 shows content of various timing information needed when the sheet discharged from the image forming apparatus 101 is stacked on the finisher 103 via the stacker 102. The capital letter T represents a time interval. The part of each suffix which comes before the comma identifies time. The part after the comma represents a source apparatus and destination apparatus of the timing information. For example, the letter i represents the image forming apparatus 101, the letter s represents the stacker 102, and the letter f represents the finisher 103. For example, "s⇒f" indicates that the given information is transmitted from the stacker 102 to the finisher 103. Besides, the small letter t such as in "t send,i" represents time.

Timing information 601 is transmitted from the image forming apparatus 101 to the stacker 102, which is the first sheet processing apparatus. The timing information 601 includes, for example, a sheet ID (SID(n)), a previous sheet ID (SID(n−1)), travel time [T arv,i⇒s], a sheet-to-sheet time interval [T ss,i⇒s], sheet-stacking-apparatus information TID, etc. (where n is a natural number). The arrow "⇒" here indicates the direction of data transmission or paper conveyance. For example, "i⇒s" indicates that paper or the like is conveyed from the image forming apparatus 101 to the stacker 102.

The sheet ID (SID(n)) is unique identification information attached to a sheet (current sheet) whose timing of discharge from the image forming apparatus 101 is to be determined. The previous sheet ID (SID(n−1)) is identification information about the sheet which is or will be discharged from the image forming apparatus 101 to the stacker 102 prior to the current sheet. If there is no previous sheet, this value is set to 0.

The travel time [T arv,i⇒s] is the time interval between the time [t send,i] when the image forming apparatus 101 transmits the timing information 601 to the stacker 102 and the time [t arv,s] when the current sheet is expected to arrive at an entrance of the stacker 102. The sheet-to-sheet time interval [T ss,i⇒s] is the time interval between the time [t i(n−1)] when the sheet (hereinafter referred to as the previous sheet) identified by the previous sheet ID is expected to be discharged from the image forming apparatus 101 and the time [t i(n)] when the current sheet is expected to be discharged from the image forming apparatus 101.

The sheet-stacking-apparatus information TID is identification information about the sheet processing apparatus on which the sheet identified by the sheet ID will be stacked.

Timing information 602 is transmitted from the stacker 102 to the finisher 103. The timing information 602 includes, for example, a sheet ID (SID(n)), a previous sheet ID (SID(n−1)), travel time [T arv,s⇒f], a sheet-to-sheet time interval [T ss,s⇒f], extension time [T ext,s], delay time [T dly,s], sheet-stacking-apparatus information TID and/or etc.

The travel time [T arv,s⇒f] is the shortest time interval between the time [t send,s] when the stacker 102 transmits the timing information 602 to the finisher 103 and the time [t arv,f] when the current sheet is expected to arrive at the finisher 103. The stacker 102 calculates the travel time [T arv,s⇒f] based on the travel time [T arv,i⇒s], the time [T pas,s] required for the current sheet to transit the stacker, and the preparation time [T prp,s] needed for preparation for receiving the current sheet. The preparation time [T prp,s] is needed, for example, for start-up and acceleration/deceleration of the conveyance rollers R.

For example, if the travel time [T arv,i⇒s] is equal to or longer than the preparation time [T prp,s], the travel time [T arv,s⇒f] can be calculated using the following equation.

$$[T\,arv,s \Rightarrow f] = [T\,pas,s] + [T\,arv,i \Rightarrow s] \quad (1)$$

On the other hand, if the travel time [T arv,i⇒s] is shorter than the time [T prp,s] required for preparation, the travel time [T arv,s⇒f] can be calculated using the following equation.

$$[T\,arv,s \Rightarrow f] = [T\,pas,s] + [T\,prp,s] \quad (2)$$

The sheet-to-sheet time interval [T ss,s⇒f] is the time interval between the time [t s(n−1)] when the previous sheet is discharged from the stacker 102 and the time [t s(n)] when the current sheet is discharged from the stacker 102. If there is no previous sheet, this value is set to 0.

The extension time [T ext,s] is used to postpone the arrival of the sheet if the stacker 102 cannot get ready for operation by the travel time [T arv,i⇒s]. As is the case with the travel time [T arv,s⇒f], the extension time [T ext,s] can be calculated based on the travel time [T arv,i⇒s] and preparation time [T prp,s].

If the travel time [T arv,i⇒s] is equal to or longer than the preparation time [T prp,s], the extension time [T ext,s] can be calculated, for example, using the following equation.

$$[T\ ext,s]=0 \quad (3)$$

On the other hand, if the travel time [T arv,i⇒s] is shorter than the preparation time [T prp,s], the extension time [T ext,s] can be calculated, for example, using the following equation.

$$[T\ ext,s]=[T\ prp,s]-[T\ arv,i\Rightarrow s] \quad (4)$$

The delay time [T dly,s] is the time by which the arrival of the sheet is delayed if the stacker 102 cannot process the current sheet within the sheet-to-sheet time interval [T ss,i⇒s]. The stacker 102 calculates the delay time [T dly,s] based on the sheet-to-sheet time interval [T ss,i⇒s] as well as on the time [T prc,s] required for processing such as switching of a flapper 205 which changes a conveyance path and start-up and acceleration/deceleration of the conveyance rollers R.

If the sheet-to-sheet time interval [T ss,i⇒s] is equal to or longer than the time [T prc,s] required for processing, the delay time [T dly,s] can be calculated, for example, using the following equation.

$$[T\ dly,s]=0 \quad (5)$$

On the other hand, if the sheet-to-sheet time interval [T ss,i⇒s] is shorter than the time [T prc,s] required for processing, the delay time [T dly,s] can be calculated, for example, using the following equation.

$$[T\ dly,s]=[T\ prc,s]-[T\ ss,i\Rightarrow s] \quad (6)$$

Timing information 603 is transmitted from the finisher 103, which operates as a sheet processing apparatus stacked with a sheet, to the image forming apparatus 101. The timing information 603 includes, for example, a sheet ID, extension time, and delay time.

The extension time [T ext,f] is used to postpone the arrival of the sheet if the finisher 103 cannot get ready for operation by the travel time [T arv,s⇒f]. The extension time [T ext,f] can be calculated based on the travel time [T arv,s⇒f] and the time [T prp,f] required for preparation for receiving the current sheet. The preparation time [T prp,f] is the time needed to move the processing tray 72 or the stack tray 73 on which the current sheet will be stacked as well as to move a stapler which will staple the current sheet.

If the travel time [T arv,s⇒f] is equal to or longer than the preparation time [T prp,f], the extension time [T ext,f] can be calculated using the following equation.

$$[T\ ext,f]=[T\ ext,s] \quad (7)$$

On the other hand, if the travel time [T arv,s⇒f] is shorter than the preparation time [T prp,f], the extension time [T ext,f] can be calculated using the following equation.

$$[T\ ext,f]=[T\ ext,s]+[T\ prp,f]-[T\ arv,s\Rightarrow f] \quad (8)$$

The delay time [T dly,f] is the time by which the arrival of the sheet is delayed if the finisher 103 cannot process the previous sheet within the sheet-to-sheet time interval [T ss,s⇒f]. The finisher 103 calculates the delay time [T dly,f] based on the sheet-to-sheet time interval [T ss,s⇒f], delay time [T dly,s], and time [T prc,f] required for processing. The time [T prc,f] required for processing includes, for example, the time required to staple the previous sheet and the time to move the processing tray 72 or the stack tray 73 on which the previous sheet will be stacked.

If the sheet-to-sheet time interval [T ss,s⇒f] is equal to or longer than the time [T prc,f] required for processing, the delay time [T dly,f] can be calculated using the following equation.

$$[T\ dly,f]=[T\ dly,s] \quad (9)$$

On the other hand, if the sheet-to-sheet time interval [T ss,s⇒f] is shorter than the time [T prc,f] required for processing, the delay time [T dly,f] can be calculated using the following equation.

$$[T\ dly,f]=[T\ dly,s]+[T\ prc,f]-[T\ ss,s\Rightarrow f] \quad (10)$$

Figure 7:
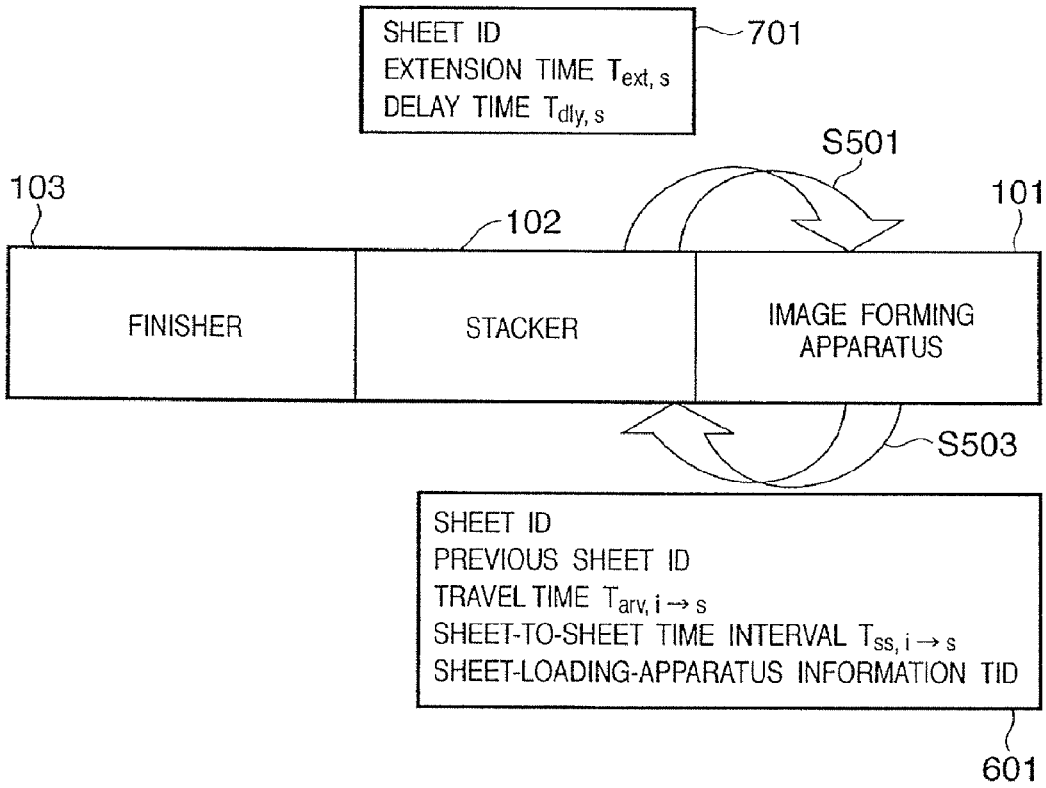
FIG. 7 is a diagram showing an example of various timing information needed when the finisher operates as a sheet processing apparatus which is stacked with sheets.

FIG. 7 is a diagram showing an example of various timing information needed when the finisher is designated as a sheet processing apparatus which is stacked with sheets. Specifically, FIG. 7 shows contends of various timing information needed when the sheet discharged from the image forming apparatus 101 is stacked on the stacker 102. Incidentally, description of items already described will be omitted.

Timing information 701 is transmitted from the stacker 102 to the image forming apparatus 101. The timing information 701 includes, for example, a sheet ID, the extension time [T ext,s], and/or the delay time [T dly,s].

Figure 8:
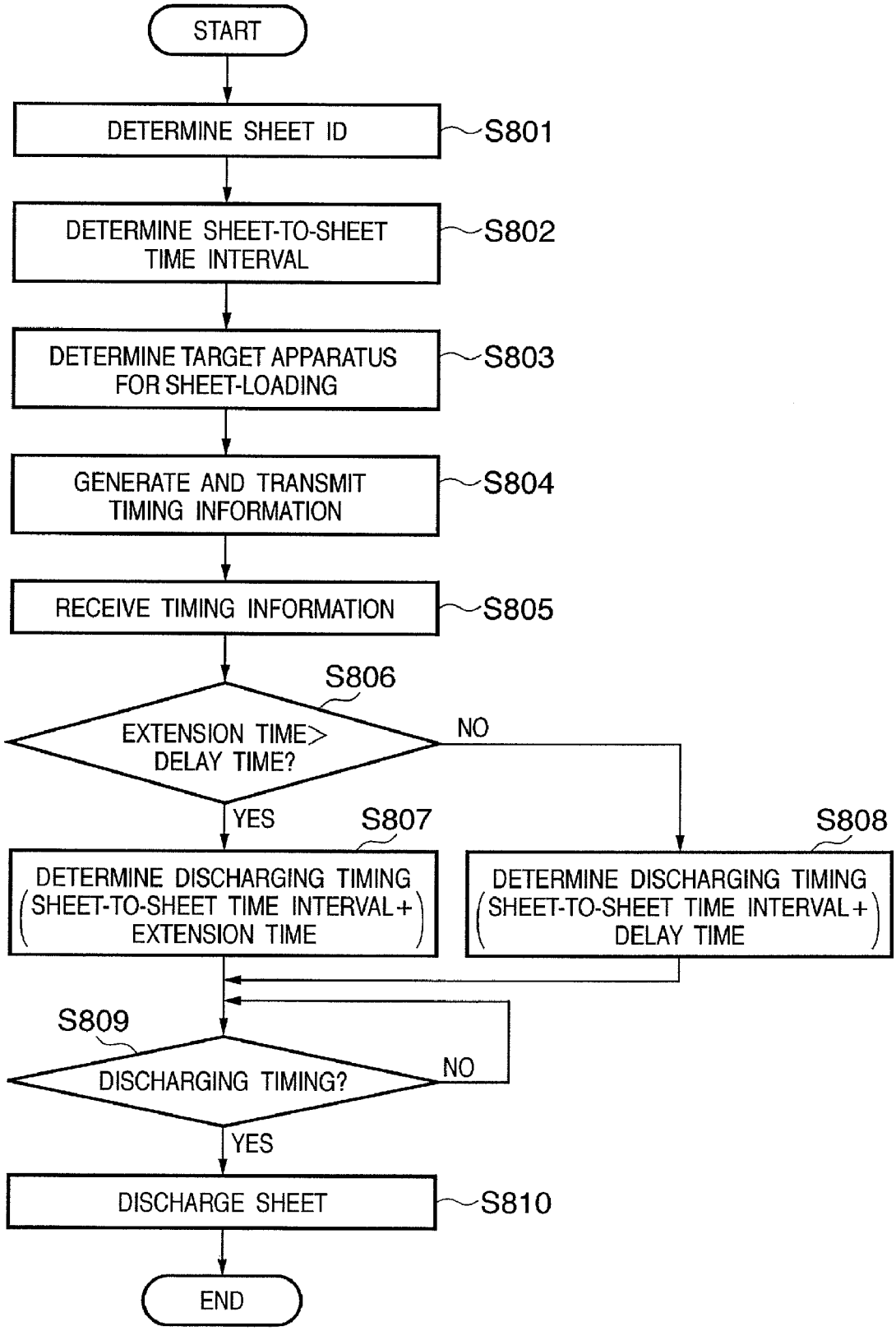
FIG. 8 is a flowchart showing an example of control processes of the image forming apparatus according to the embodiment.

FIG. 8 is a flowchart showing an example of control processes of the image forming apparatus according to the embodiment.

In Step S801, the CPU 311 determines the ID of the current sheet. If it is the n-th sheet, "n" is substituted in the sheet ID and "n−1" is substituted in the pervious sheet ID.

In Step S802, the CPU 311 determines the travel time [T arv,i⇒s] and sheet-to-sheet time interval [T ss,i⇒s]. The travel time [T arv,i⇒s] is a fixed value determined in advance, and it is read from the ROM 313. If there is no previous sheet, 0 is assigned to the sheet-to-sheet time interval [T ss,i⇒s].

In Step S803, the CPU 311 determines the second sheet processing apparatus (sheet-stacking apparatus) which will be stacked with the current sheet. Identification information about the sheet-stacking apparatus is substituted in the sheet-stacking-apparatus information TID. The sheet-stacking apparatus is specified, for example, by the controller 200. This is because the controller 200 manages image forming jobs and is aware of sheet processing performed on sheets.

In Step S804, the CPU 311 generates timing information 601 from the determined travel time, sheet-to-sheet time interval, and sheet-stacking-apparatus information. Furthermore, the CPU 311 transmits the generated timing information 601 to the stacker 102 which is the first sheet processing apparatus.

In Step S805, the CPU 311 receives timing information 603 (or 701) from the second sheet processing apparatus (stacker 102 or finisher 103). The timing information 701 may be received from the second sheet processing apparatus either directly or via another sheet processing apparatus.

In Step S806, the CPU 311 reads the extension time and delay time from the received timing information and determines whether the extension time is longer than the delay time. If the extension time is longer than the delay time, the CPU 311 goes to Step S807. Even if there is no previous sheet, the CPU 311 goes to Step S807.

In Step S807, the CPU 311 determines the discharge timing of the current sheet based on the extension time contained in the received timing information. For example, if the current sheet is stacked on the finisher 103, the CPU 311 calculates an adjustment time by adding the extension time [T ext,f] to the sheet-to-sheet time interval [T ss,i⇒s]. On the other hand, if the current sheet is stacked on the stacker 102, the CPU 311 calculates an adjustment time by adding the extension time [T ext,s] to the sheet-to-sheet time interval [T ss,i⇒s]. The CPU 311 sets the discharge timing to the time obtained by adding at least the adjustment time to the time at which the timing information 601 is sent out. It is assumed that the interval between the time when the image forming apparatus 101 serving as a reference sends out the timing information 601 and the time when the image forming apparatus 101 receives the timing information 603 is negligible since it is very short compared to the adjustment time, extension time, and the like.

On the other hand, if the extension time is equal to or shorter than the delay time, the CPU 311 goes to Step S808. In Step S808, the CPU 311 determines the discharge timing of the current sheet based on the delay time contained in the received timing information. For example, if the current sheet is stacked on the finisher 103, the CPU 311 calculates an adjustment time by adding the delay time [T dly,f] to the sheet-to-sheet time interval [T ss,i⇒s]. On the other hand, if the current sheet is stacked on the stacker 102, the CPU 311 calculates an adjustment time by adding the delay time [T dly,s] to the sheet-to-sheet time interval [T ss,i⇒s]. The CPU 311 sets the discharge timing to the time obtained by adding at least the adjustment time to the time at which the timing information 601 is sent out.

In Step S809, the CPU 311 determines, using an internal timer, whether the determined discharge timing has come, and thereby waits for the discharge timing. When the discharge timing comes, the CPU 311 goes to Step S810.

In Step S810, the CPU 311 discharges the current sheet to the stacker 102. The adjustment of discharge timing has the same meaning as adjustment of the sheet-to-sheet time interval between the previous sheet and current sheet. That is, the adjustment of discharge timing is equivalent to adjustment of the conveyance timing of a sheet suspended by the registration roller 34. The adjustment of the sheet conveyance timing indicates adding an adjustment time to default sheet conveyance timing which does not take into consideration the delay time or adjustment time on the sheet processing apparatus. Thus, the wait for discharging timing in Step S809 is equivalent to a wait for a sheet conveyance timing on the registration roller 34.

In FIGS. 6 to 8, delay time and extension time are contained in the timing information. However, the timing information may include only the delay time or extension time whichever is longer. In that case, the process of Step S806 will be performed on the second sheet processing apparatus, and thus the image forming apparatus 101 may be able to omit Step S806.

Figure 9:
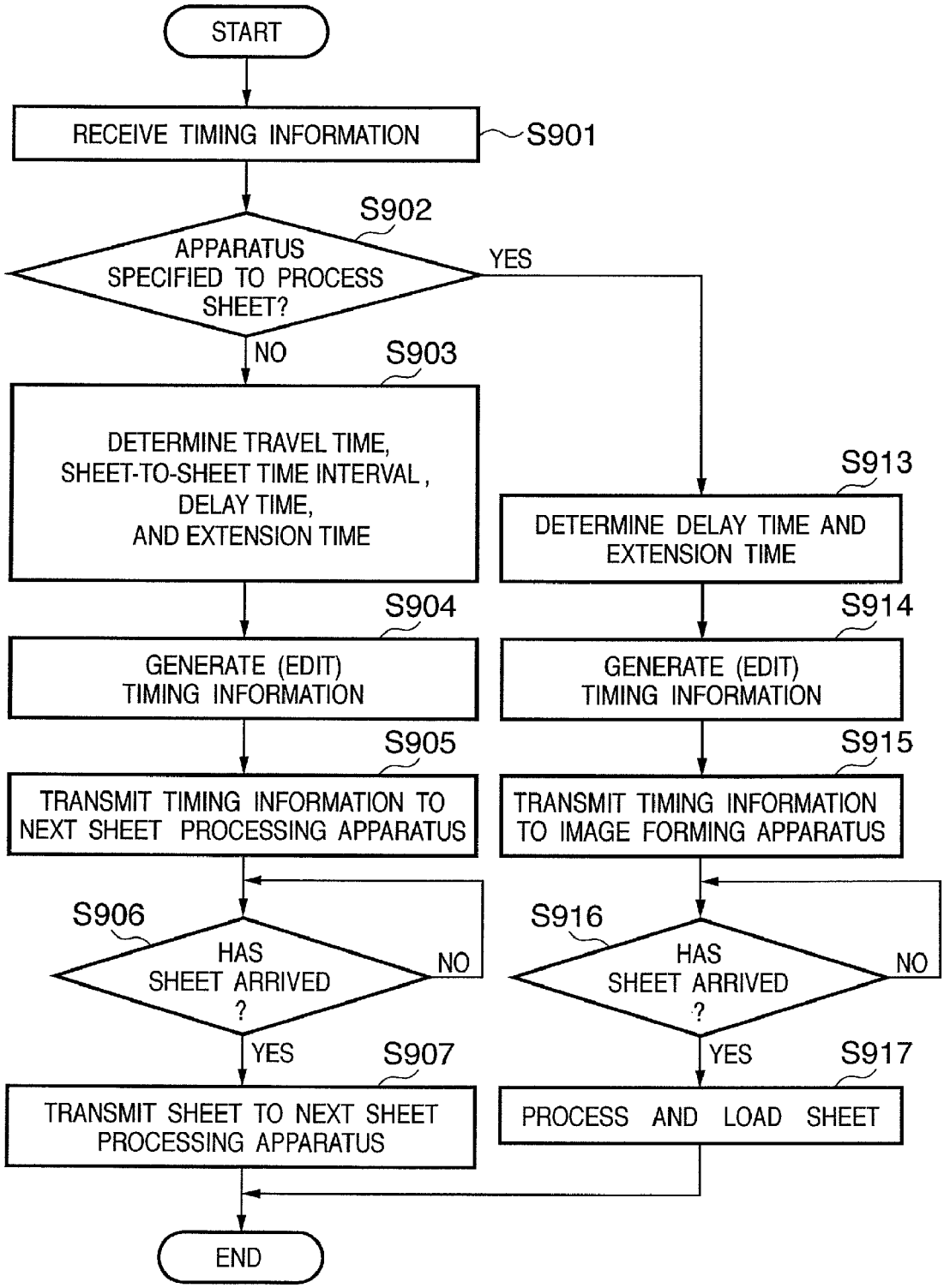
FIG. 9 is an exemplary flowchart of control processes of the sheet processing apparatus according to the embodiment.

FIG. 9 is an exemplary flowchart of control processes of the sheet processing apparatus according to the embodiment. The flowchart generalizes control processes of the stacker 102 and finisher 103.

In Step S901, the CPU 411 of the sheet processing apparatus receives timing information from the image forming apparatus 101 or an upstream sheet processing apparatus via the device-to-device interface 416.

In Step S902, the CPU 411 determines, based on the received timing information, whether the sheet processing apparatus itself is specified as an apparatus which should be stacked with a sheet. For example, the CPU 411 reads sheet-stacking-apparatus information TID out of the received timing information and compares it with the TID set on the sheet processing apparatus itself. If the sheet processing apparatus is not specified, the CPU 411 goes to Step S903.

In Step S903, the CPU 411 prepares various information needed to generate timing information 602. The various information includes, for example, travel time [T arv,s⇒f], sheet-to-sheet time interval [T ss,s⇒f], extension time [T ext,s], and delay time [T dly,s] such as described above. Regarding the sheet ID, previous sheet ID, and sheet-stacking-apparatus information TID, the CPU 411 uses those contained in the received timing information 601.

In Step S904, the CPU 411 generates timing information 602 from the various information it has prepared. The timing information 602 may be generated by editing the timing information 601.

In Step S905, the CPU 411 transmits the generated timing information 602 to the adjacent downstream sheet processing apparatus. Besides, the CPU 411 performs a preparation process needed to transit the current sheet. For example, it sends out instructions ordering the device control unit 314 to change to another flapper.

In Step S906, the CPU 411 waits for the current sheet to arrive. The arrival of the current sheet is detected by a sheet sensor or the like. When the sheet arrives, the CPU 411 goes to Step S907.

In Step S907, the CPU 411 sends out instructions ordering the device control unit 314 to transit the current sheet to the next sheet processing apparatus.

On the other hand, if it is found in Step S902 that its host apparatus is specified, the CPU 411 goes to Step S913. In Step S913, the CPU 411 prepares various information needed to generate timing information 603 or 701. The various information includes, for example, extension time [T ext,s] (or [T ext,f]) and delay time [T dly,s] (or [T dly,f]) such as described above. Regarding the sheet ID, the CPU 411 uses the one contained in the received timing information 601 or 602. The CPU 411 may determine which is longer, the extension time or delay time. Then, the CPU 411 can include only the longer of the extension time and delay time in the timing information. This gives the image forming apparatus 101 the advantage of being able to omit Step S913.

In Step S914, the CPU 411 generates timing information 603 or 701 from the prepared various information. The timing information 603, 701 may be generated by editing the timing information 602, 601.

In Step S915, the CPU 411 transmits the generated timing information to the image forming apparatus 101. Besides, the CPU 411 performs a preparation process needed to process and stack the current sheet. For example, it sends out instructions ordering the device control unit 314 to change to another flapper or move a stapler.

In Step S916, the CPU 411 waits for the current sheet to arrive. The arrival of the current sheet is detected by a sheet sensor or the like. When the sheet arrives, the CPU 411 goes to Step S917.

In Step S917, the CPU 411 sends out instructions ordering the device control unit 314 to subject the current sheet to sheet processing (e.g., a stapling process or punch process) and stack it on a tray (tray 41 or 83).

EXAMPLE

The control method of the sheet discharge timing described so far will be described citing concrete figures. Description will be given here of an example in which three sheets (SID=1, 2, 3) are stacked on different sheet processing apparatus. It is assumed here that the first sheet (SID=1) is stacked on the finisher 103, that the second sheet (SID=2) is stacked on the stacker 102, and that the third sheet (SID=3) is stacked on the finisher 103.

FIG. 10 is a diagram showing an example of timing information about the first sheet. FIG. 11 is a diagram showing an example of timing information about the second sheet. FIG. 12 is a diagram showing an example of timing information about the third sheet.

It is assumed that the time [T pas,s] required to transit through the stacker 102 is 800 ms, that the time [T prp,s] required for preparation of the stacker 102 is 300 ms, and that the time [T prc,s] required for processing on the stacker 102 is 300 ms. Also, it is assumed that the time [T prp,f] required for preparation of the finisher 103 is 2,000 ms and that the time [T prc,f] required for processing on the finisher 103 is 4,100 ms.

Figure 13:
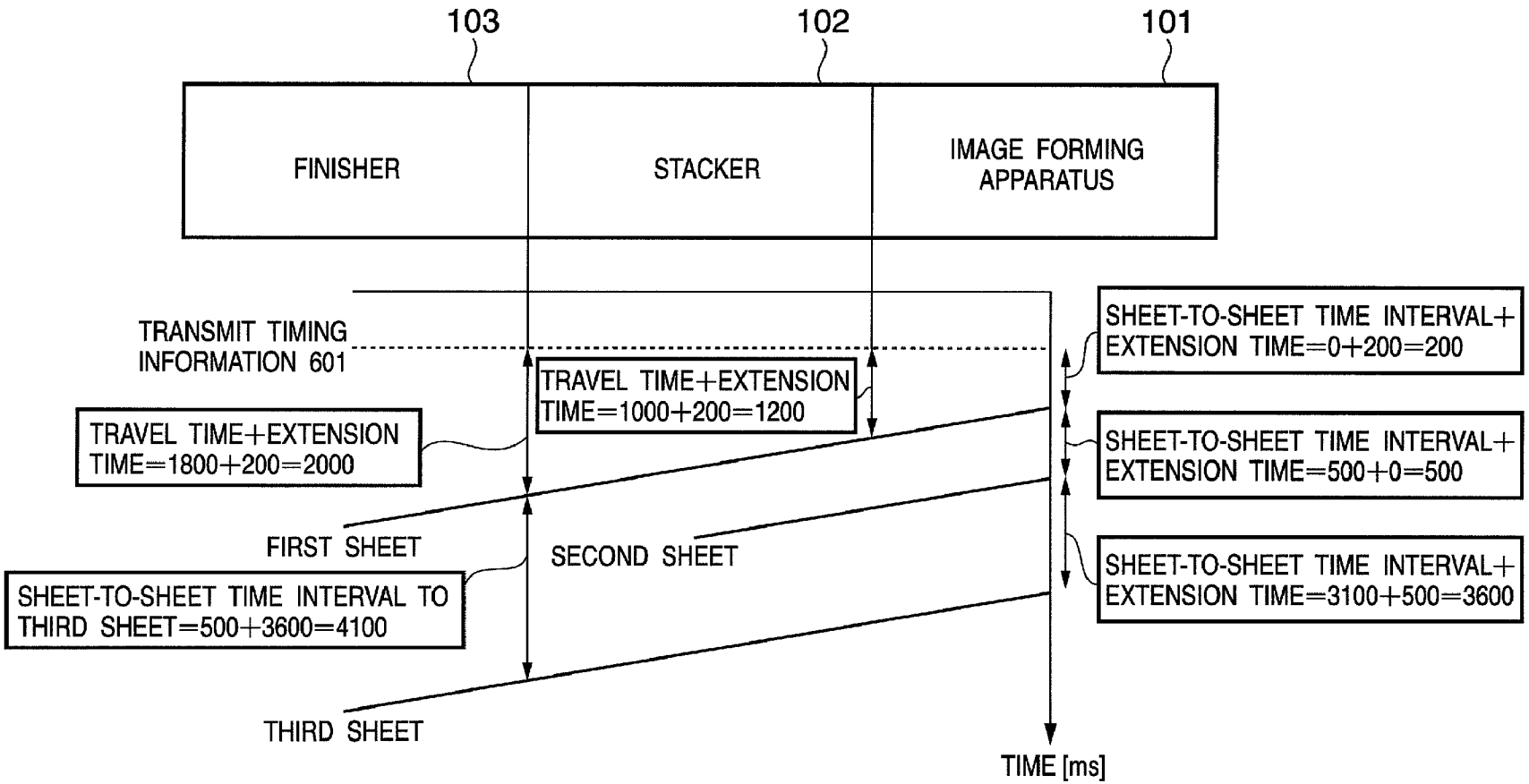
FIG. 13 is a diagram showing an example of sheet intervals among the first to third sheets.

FIG. 13 is a diagram showing an example of sheet intervals among the first to third sheets. There is no previous sheet for the first sheet 1. Also, according to Equation (8) above, the extension time [T ext,f] is 200 ms. Thus, the image forming apparatus 101 starts discharging the first sheet 200 ms after transmitting the timing information 601 to the stacker 102. The discharge timing is calculated as follows:

$$\begin{aligned}\text{Sheet-to-sheet time interval}[T\ ss, i \Rightarrow s] + \text{extension time}[T\ ext, f] &= 0 + 200 \\ &= 200\end{aligned}$$

The first sheet reaches the stacker entrance 1,200 ms after transmission of the timing information 601 to the stacker 102. The time is calculated as follows:

$$\begin{aligned}\text{Travel time}[T\ arv, i \Rightarrow s] + \text{extension time}[T\ ext, f] &= 1000 + 200 \\ &= 1200\end{aligned}$$

The time [T prp,s] required for preparation of the stacker 102 is 300 ms. Thus, the first sheet reaches the stacker 102 after the preparation of the stacker 102 is completed.

Also, according to Equation (1), the travel time [T arv,s⇒f] is 1,800 ms. Thus, the first sheet reaches the finisher entrance 2,000 ms after the image forming apparatus 101 transmits the timing information 601 to the stacker 102. The time is calculated as follows:

$$\begin{aligned}\text{Travel time}[T\ arv, i \Rightarrow s] + \text{extension time}[T\ ext, f] &= 1800 + 200 \\ &= 2000\end{aligned}$$

The time [T prp,f] required for preparation of the finisher 103 is 2,000 ms. Thus, the first sheet reaches the finisher 103 upon completion of the preparation of the finisher 103.

Therefore, the first sheet will never reach the stacker 102 before the preparation of the stacker 102 is completed. The first sheet will never reach the finisher 103 before the preparation of the finisher 103 is completed either. This prevents jams. Furthermore, since the first sheet reaches the finisher 103 upon completion of the preparation of the finisher 103, the image forming apparatus 101 does not have to keep the first sheet waiting needlessly at the registration roller 34. Thus, the sheet can be discharged with the best processing efficiency. However, some leeway may be provided in the discharge timing to allow for machine errors and the like.

Regarding the second sheet, the extension time [T ext,s] is 0 according to Equation (3) and the delay time [T dly,s] is 0 according to Equation (7). Consequently, the extension time [T ext,s] is not longer than the delay time [T dly,s]. Thus, the image forming apparatus 101 discharges the second sheet by adjusting the sheet-to-sheet time interval between the first sheet which is the previous sheet and the second sheet which is the current sheet to be 500 ms. At this time, the sheet-to-sheet time is calculated as follows:

$$\begin{aligned}\text{Sheet-to-sheet time interval}[T\ ss, i \Rightarrow s] + \text{delay time}[T\ dly, f] &= 500 + 0 \\ &= 500\end{aligned}$$

As described above, the time [T prc,s] required for processing on the stacker 102 is 300 ms. Thus, the second sheet reaches the stacker 102 after the first sheet has been processed by the stacker 102.

Consequently, the second sheet will never reach the stacker 102 before the first sheet has been processed by the stacker 102. This prevents the second sheet from jamming the stacker 102. Also, the interval between the first sheet and second sheet is equivalent to the sheet-to-sheet time interval [T ss,i ⇒s]. Thus, the image forming apparatus 101 will never keep the second sheet waiting needlessly. In this way, even in the presence of the previous sheet, the current sheet can be discharged with the best processing efficiency.

Regarding the third sheet, the extension time [T ext,f] is 0 according to Equation (3) and the delay time [T dly,f] is 0 according to Equation (7). Consequently, the extension time [T ext,f] is not longer than the delay time [T dly,f]. Also, the delay time [T dly,f] is 3,100 ms according to Equation (10). Thus, the image forming apparatus 101 adjusts the timing to discharge the third sheet so that the sheet-to-sheet time interval between the second sheet and third sheet will be 3,600 ms. At this time, the sheet-to-sheet time is calculated as follows:

$$\begin{aligned}\text{Default sheet-to sheet time interval}[T\ ss, i \Rightarrow s] + \text{delay time}[T\ dly, f] &= 500 + 3100 \\ &= 3600\end{aligned}$$

The sheet-to-sheet time interval between the first sheet and third sheet is 4,100 ms (i.e., 500+3600=4100). Also, the time [T prc,f] required for processing on the finisher 103 is 4,100 ms. Thus, the third sheet 3 reaches the finisher 103 upon completion of the processing of the first sheet on the finisher 103.

Consequently, the third sheet will never reach the stacker 102 before the processing on the stacker 102 is completed. The third sheet will never reach the finisher 103 before the processing on the finisher 103 is completed either. This prevents the third sheet from causing a jam.

Furthermore, since the third sheet 3 reaches the finisher 103 upon completion of the processing of the first sheet on the finisher 103, the image forming apparatus 101 will never keep the third sheet waiting needlessly.

In this way, even if the previous sheet is stacked on the stacker 102 located upstream of the finisher 103, the current sheet can be discharged with the best processing efficiency.

As described above, according to this embodiment, timing information is relayed, by being edited repeatedly, from the first sheet processing apparatus directly connected to the image forming apparatus to the second sheet processing apparatus which processes the sheet. The image forming apparatus discharges the sheet by determining sheet discharge timing based on the timing information received from the second sheet processing apparatus. In this way, by considering the sheet processing apparatus up to the one which actually processes the sheet instead of considering all the sheet processing apparatus connected to the image forming apparatus, it is possible to achieve a higher processing efficiency than the latter case.

In short, the discharge timing is determined by taking into consideration the sheet processing apparatus which requires the longest waiting time until the sheet is ready to be accepted out of the sheet processing apparatus ranging from the first sheet processing apparatus to the second sheet processing apparatus. The discharge timing may be determined with some leeway. The leeway time is provided to allow for machine errors and the like. This will in effect, essentially maximize the processing efficiency.

Preferably, on each of the sheet processing apparatus located between the first sheet processing apparatus and second sheet processing apparatus, the timing information includes, for example, the travel time required for the sheet to travel from the image forming apparatus, the time required to transit the sheet or preparation time of mechanisms which process the sheet, and the like. These times are very important in determining the discharge timing because they play a decisive role in discharging the sheet efficiently. Of course, it is desirable to take these times into consideration also in order to prevent jams.

Furthermore, the timing information may be prepared by taking into consideration, for example, the sheet-to-sheet time interval between the arrival of the previous sheet and arrival of the current sheet, the time required to transit the sheet or preparation time of mechanisms which process the sheet, and the like. That is, by taking these times into consideration, the sheet processing apparatus which pass the sheet can avoid jams and improve processing efficiency.

Furthermore, the timing information relayed to the second sheet processing apparatus includes identification information which identifies the second sheet processing apparatus. The identification information makes it easy to identify on which sheet processing apparatus the sheet will be stacked and processed.

In addition, the present invention becomes more advantageous if the plurality of sheet processing apparatuses include two or more sheet processing apparatus which have a sheet-stacking function. Among other things, conventional techniques, which do not assume that a plurality of sheet processing apparatuses have a sheet-stacking function, cannot control sheet discharge timing properly. Consequently, with the conventional techniques, it is necessary to restart the image forming system including the stacker and finisher after shutting it down once. Alternatively, it is necessary to increase sheet intervals more than necessary. Thus, conventionally, switching a sheet processing apparatus stacked with sheets among a plurality of sheet processing apparatuses can result in an extreme drop in processing efficiency of the image forming apparatus. On the other hand, the present invention with the above configuration is greatly superior in that it can properly solve these problems.

Also, the timing to discharge the sheet from the image forming apparatus may be adjusted by stopping the sheet temporarily at another location on the conveyance path or changing the conveyance speed instead of adjusting re-conveyance timing using the registration roller. In that case, when suspending the sheet or changing the conveyance speed, it is necessary to make sure that the sheet is not passing through a fixing device 37.

The sheet processing apparatus described above receives timing information from the image forming apparatus or upstream sheet processing apparatus and determines, based on the received timing information, whether the sheet processing apparatus itself is specified to process a sheet. If it is not specified, the sheet processing apparatus edits the timing information taking into consideration the transit time required to transit the sheet. The timing information is transferred to the downstream sheet processing apparatus.

On the other hand, if the sheet processing apparatus itself is specified, the sheet processing apparatus edits the timing information taking into consideration the preparation time of the mechanisms which perform sheet processing. The timing information is transferred to the image forming apparatus.

In this way, since each sheet processing apparatus edits the timing information taking into consideration the transit time of the sheet, the preparation time needed for processing of the sheet, and the like, it is possible to minimize unnecessary waiting time and determine precise discharge timing which can avoid jams.

Incidentally, even if a paper feeder is installed upstream of the image forming apparatus, timing information is transmitted from the paper feeder to the image forming apparatus, enabling the same processing as in the above embodiment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image forming apparatus which uses a plurality of sheet processing apparatuses serially connected and equipped with the same or different sheet processing functions, the image forming apparatus comprising:

a conveyance device which conveys sheets;

a transmitting device which transmits timing information for use to determine a discharge timing of a sheet, the timing information including arrival time information indicating an arrival time at which the sheet arrives at a first sheet processing apparatus and a feeding interval of sheets to the first sheet processing apparatus;

a receiving device which receives edited timing information, which is the timing information that has been edited and relayed from the first sheet processing apparatus to a second sheet processing apparatus as a target sheet processing apparatus to which the sheet is loaded; and a controller which (a) compares extension time information included in the edited timing information with delay time information included in the edited timing information, the extension time information indicating an extension time necessary to postpone the arrival time of the sheet such that the second sheet processing apparatus finishes a preparation operation before the arrival of the sheet, and the delay time information indicating a delay time necessary to postpone an arrival time of a next sheet such that the second sheet processing apparatus finishes a sheet process of the sheet before the arrival of the next sheet, (b) determines the discharging timing of the sheet based on the arrival time information and the longer one of the extension time and the delay time, and (c) controls said conveyance device so that the sheet will be discharged at the determined discharging timing, wherein the arrival time information is edited by adding time consumed to pass through other sheet processing apparatuses connected between the first and second sheet processing apparatuses.

2. The image forming apparatus according to claim 1, wherein the timing information relayed to the target sheet processing apparatus includes identification information which identifies the target sheet processing apparatus.

3. The image forming apparatus according to claim 1, wherein the plurality of sheet processing apparatuses include two or more sheet processing apparatuses which have a sheet-stacking function.

4. The image forming apparatus according to claim 1, wherein the timing information is transmitted from said transmitting device sheet by sheet.

5. The image forming apparatus according to claim 1, wherein the extension time information is determined by adding the arrival time information included in the received timing information to a preparation time required to prepare reception of the sheet by the second sheet processing apparatus.

6. The image forming apparatus according to claim 1, wherein the delay time information is determined by adding the feeding interval included in the received timing information to a time required to perform the sheet process by said second sheet processing apparatus.

7. A sheet discharge method for an image forming apparatus which uses a plurality of sheet processing apparatuses serially connected and equipped with the same or different sheet processing functions, the method comprising the steps of:

transmitting timing information for use to determine a discharge timing of a sheet, the timing information including arrival time information indicating an arrival time at which the sheet arrives at a first sheet processing apparatus and a feeding interval of sheets to the first sheet processing apparatus;

receiving edited timing information which is the timing information that has been edited and relayed from the first sheet processing apparatus to a second sheet processing apparatus as a target sheet processing apparatus to which the sheet is loaded;

comparing extension time information included in the timing information with delay time information included in the timing information, the extension time information indicating an extension time necessary to postpone the arrival time of the sheet such that the second sheet processing apparatus finishes a preparation operation before the arrival of the sheet, and the delay time information indicates a delay time necessary to postpone an arrival time of a next sheet such that the second sheet processing apparatus finishes a sheet process of the sheet before the arrival of the next sheet;

determining the discharging timing of the sheet based on the arrival time information and the longer one of the extension time and the delay time; and controlling a conveyance device so that the sheet will be discharged at the determined discharging timing, wherein the arrival time information is edited by adding time consumed to pass through other sheet processing apparatuses connected between the first and second sheet processing apparatuses.

* * * * *